US007290732B2

(12) United States Patent
Wilmoth et al.

(10) Patent No.: US 7,290,732 B2
(45) Date of Patent: Nov. 6, 2007

(54) SYSTEMS, APPARATUSES AND METHODS FOR CUTTING AND SPOOLING PAPER

(75) Inventors: Bryan Nathan Wilmoth, Griffin, GA (US); William Russell Stitcher, Moreland, GA (US); Joseph K. Popwell, Newnan, GA (US); Bobbie D. Peacock, Peachtree City, GA (US)

(73) Assignee: M.A. Industries, Inc., Peachtree City, GA (US)

( * ) Notice: Subject to any disclaimer, the term of this patent is extended or adjusted under 35 U.S.C. 154(b) by 130 days.

(21) Appl. No.: 10/763,718

(22) Filed: Jan. 23, 2004

(65) Prior Publication Data

US 2004/0194595 A1 Oct. 7, 2004

Related U.S. Application Data

(60) Provisional application No. 60/441,951, filed on Jan. 23, 2003.

(51) Int. Cl.
*B65H 35/08* (2006.01)

(52) U.S. Cl. ..... 242/526.2; 242/394; 242/395; 242/615.3

(58) Field of Classification Search ..... 242/526.2, 242/615.3, 615.4, 394, 395; 226/166
See application file for complete search history.

(56) References Cited

U.S. PATENT DOCUMENTS

| | | | |
|---|---|---|---|
| 2,343,047 | A | 2/1944 | Doyle et al. |
| 2,461,246 | A | 2/1949 | Weyenberg |
| 2,889,922 | A | 6/1959 | Clarvoe |
| 3,126,312 | A | 3/1964 | Nickerson |
| 3,131,843 | A | 5/1964 | Bentley |
| 3,135,446 | A | 6/1964 | Sargent |
| 3,406,084 | A | 10/1968 | Varga |
| 3,421,675 | A | 1/1969 | Brown et al. |
| 3,497,050 | A | 2/1970 | Landgraf |
| 3,552,101 | A | 1/1971 | Papp |
| 3,588,346 | A | 6/1971 | Ramig, Jr. |
| 3,599,888 | A | 8/1971 | Coudriet et al. |
| 3,658,628 | A | 4/1972 | Zenter |
| 3,746,234 | A | 7/1973 | Mischo et al. |
| 3,765,615 | A | 10/1973 | Brink et al. |
| 3,836,095 | A | 9/1974 | Krühn |
| 3,854,642 | A | 12/1974 | Mueller |
| 3,902,956 | A | 9/1975 | Thompson, Jr. |
| 3,969,181 | A | 7/1976 | Seabold |
| 4,004,962 | A | 1/1977 | Kleid |
| 4,061,527 | A | 12/1977 | Traise |
| 4,100,681 | A | 7/1978 | Hollander |
| 4,106,324 | A | 8/1978 | Gotz |

(Continued)

*Primary Examiner*—Peter M. Cuomo
*Assistant Examiner*—Sang Kim
(74) *Attorney, Agent, or Firm*—Kilpatrick Stockton LLP

(57) ABSTRACT

Systems, apparatuses and methods for cutting and spooling paper are described. In one embodiment, a system for cutting a traveling web of paper that is being wound onto a first spool and transferring the paper web onto a second spool by feeding turn-up tape into a nip between the second spool and the paper web, comprises a transfer track for transporting the turn-up tape beneath the paper web and to a position adjacent to the nip, and a drive assembly capable of driving the turn-up tape along the transfer track toward the nip, wherein the drive is capable of being powered by manual power or motor power.

11 Claims, 11 Drawing Sheets

U.S. PATENT DOCUMENTS 4,177,724 A 12/1979 Johnson, III et al.
4,264,396 A 4/1981 Stewart
4,265,176 A 5/1981 Sato
4,293,100 A 10/1981 Sharlow
4,295,916 A 10/1981 Stevens
4,335,858 A 6/1982 Cranna
4,358,979 A 11/1982 Kurzbuch
4,414,258 A 11/1983 Corbin, Sr.
4,582,558 A 4/1986 Antonson
4,605,147 A 8/1986 Kato
4,659,029 A 4/1987 Rodriguez
4,661,185 A 4/1987 Kobiella
4,711,404 A 12/1987 Falk
4,718,971 A 1/1988 Summers
4,757,950 A 7/1988 Rodriguez
4,781,110 A 11/1988 Sakaki et al.
4,783,018 A 11/1988 Rodriguez
4,826,562 A 5/1989 Ehlis
4,869,775 A 9/1989 Quittner
4,938,009 A 7/1990 Takami
4,964,584 A 10/1990 Taipale et al.
5,046,675 A 9/1991 Rodriguez
5,178,717 A 1/1993 Rodriguez
5,277,731 A 1/1994 Krimsky et al.
5,294,407 A 3/1994 Succi et al.
5,338,590 A 8/1994 Rodriguez
5,417,383 A 5/1995 Rodriguez et al.
5,453,141 A 9/1995 Rodriguez
5,456,792 A 10/1995 Rodriguez et al.
5,467,937 A 11/1995 Rodriquez et al.
5,560,180 A 10/1996 Rodriguez et al.
5,637,170 A 6/1997 Rodriguez
5,810,279 A 9/1998 Rodriguez et al.
5,913,489 A 6/1999 Rodriquez et al.
5,954,290 A 9/1999 Rodriguez et al.
6,182,917 B1 * 2/2001 Lai ..... 242/390.8
6,230,724 B1 * 5/2001 Lai ..... 135/20.3
6,305,634 B1 10/2001 Rodriguez
6,416,012 B1 7/2002 Wilmoth et al.

* cited by examiner

SYSTEMS, APPARATUSES AND METHODS FOR CUTTING AND SPOOLING PAPER

RELATED APPLICATION

This application claims priority to U.S. Provisional Patent Application Ser. No. 60/441,951 filed Jan. 23, 2003, which is hereby incorporated in its entirety by this reference.

FIELD OF THE INVENTION

The field of this invention is systems related to paper producing and methods of operating the same. More specifically, this invention relates to systems, apparatuses and methods for cutting and spooling a traveling web of paper.

BACKGROUND OF THE INVENTION

Paper is typically produced in wide, continuous sheets or webs. As the web is produced, it is wound onto a spool. As each spool is filled it is necessary to transfer the web to an empty spool. However, because of the manner in which paper producing machines operate, it is difficult and expensive to shut down the machine while the web is cut and transferred to a new spool. Thus, methods for transferring the paper web from a full to an empty spool without interrupting the paper producing machines have been developed. For example, U.S. Pat. No. 4,414,258 to Corbin ("Corbin"), entitled "Turn-up Tape," discloses the manual application of a paper ribbon or "turn-up tape" to a spinning empty spool that is positioned above the moving web of paper. The trailing end of the turn-up tape is positioned underneath the web. As the turn-up tape is wound onto the spinning empty spool, it cuts across the moving web, thereby tearing the web and simultaneously holding the cut end of the web against the empty spool. In this manner, the web is transferred to the empty spool with no interruption or interference with the continuous production of the paper web.

Manual application of turn-up tape to empty spools presents certain disadvantages. For instance, the operator responsible for applying the turn-up tape is exposed to dangerous, high-speed equipment. Moreover, manual application is prone to errors in positioning and timing. Thus, machines for applying the turn-up tape to the empty spools have been developed. For example, U.S. Pat. No. 4,659,029 to Rodriguez, entitled "Apparatus and Method for Cutting and Spooling a Web of Paper," discloses a turn-up tape machine having a hand driven tape drive, a tape-cutting mechanism, an open guideway and a brake. The turn-up tape is propelled into and along the guideway by the tape drive manually powered by a hand crank. It is also known to propel the turn-up tape through the guideway via a motor powered tape drive. The guideway travels under the paper web and curves up and around so that the exit of the guideway is positioned adjacent to the "nip" or the point where the paper web is tangent to the empty spool. The turn-up tape is forced through the guideway and into the nip. When the turn-up tape is pushed into the nip, it sticks to the spool, is pulled out of the guideway and tears the paper web as described above. An example of such a motor-powered system is described in U.S. Pat. No. 6,416,012 entitled "Apparatuses and Methods for Cutting and Spooling Paper." Various methods are known for introducing the end of the turn-up tape into the nip.

Many current systems for cutting and spooling paper are highly automated and utilize a computer to control much of the operation. However, these systems do not provide for a manual back-up if there is an electrical system failure or other failure that results in the non-functioning of the automatic operation of the system. As a result, operators may have to resort to dangerous and primitive techniques to transfer a paper web to a new spool.

SUMMARY

Systems, apparatuses and methods are described for cutting a traveling web of paper that is being spooled on a first spool and transferring the paper web to spool on a second spool by driving turn-up tape into a nip between the second spool and the paper web. The systems, apparatuses and methods provide for a switch between automatic operation and manual operation and provide a drive assembly that allows for a switch between motor power and manual power. In one embodiment, a system for cutting a traveling web of paper that is being wound onto a first spool and transferring the paper web onto a second spool by feeding turn-up tape into a nip between the second spool and the paper web, comprises a transfer track for transporting the turn-up tape beneath the paper web and to a position adjacent to the nip, and a drive assembly capable of driving the turn-up tape along the transfer track toward the nip, wherein the drive is capable of being powered by manual power or motor power. In one embodiment, the transfer track comprises at least in part a V-shaped groove capable of containing the turn-up tape. The V-shaped groove can comprise a first side wall and a second side wall at an acute angle from the first side wall and the second side wall can comprise a concave portion.

Further details and advantages of the present invention are set forth below.

BRIEF DESCRIPTION OF THE DRAWINGS

The accompanying drawings, which are incorporated in and form a part of the specification, illustrate exemplary embodiments of the present invention and, together with the description, disclose principles of the invention. In the drawings.

DETAILED DESCRIPTION

Figure 1:
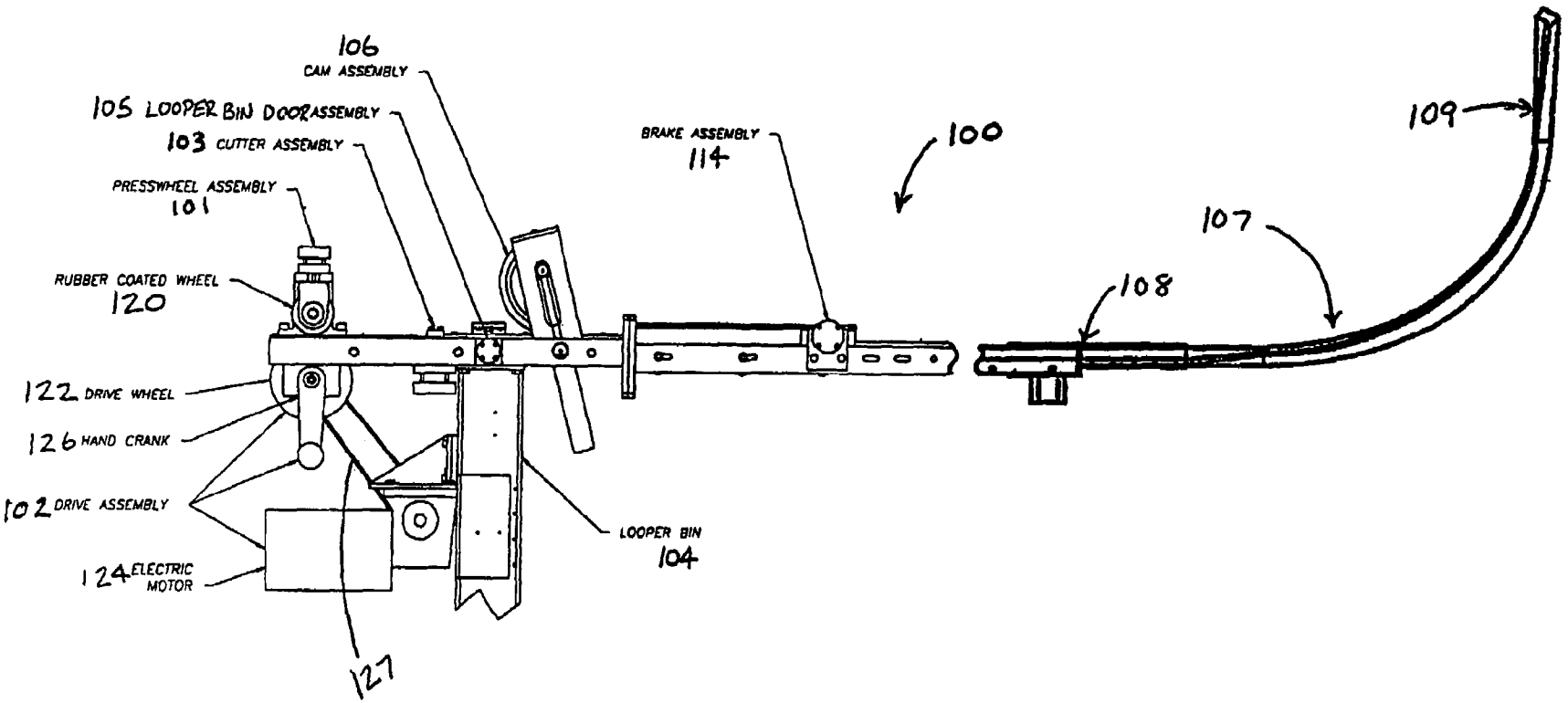
FIG. 1 is an illustration of the turn-up tape system according to one embodiment of the present invention.
Figure 2:
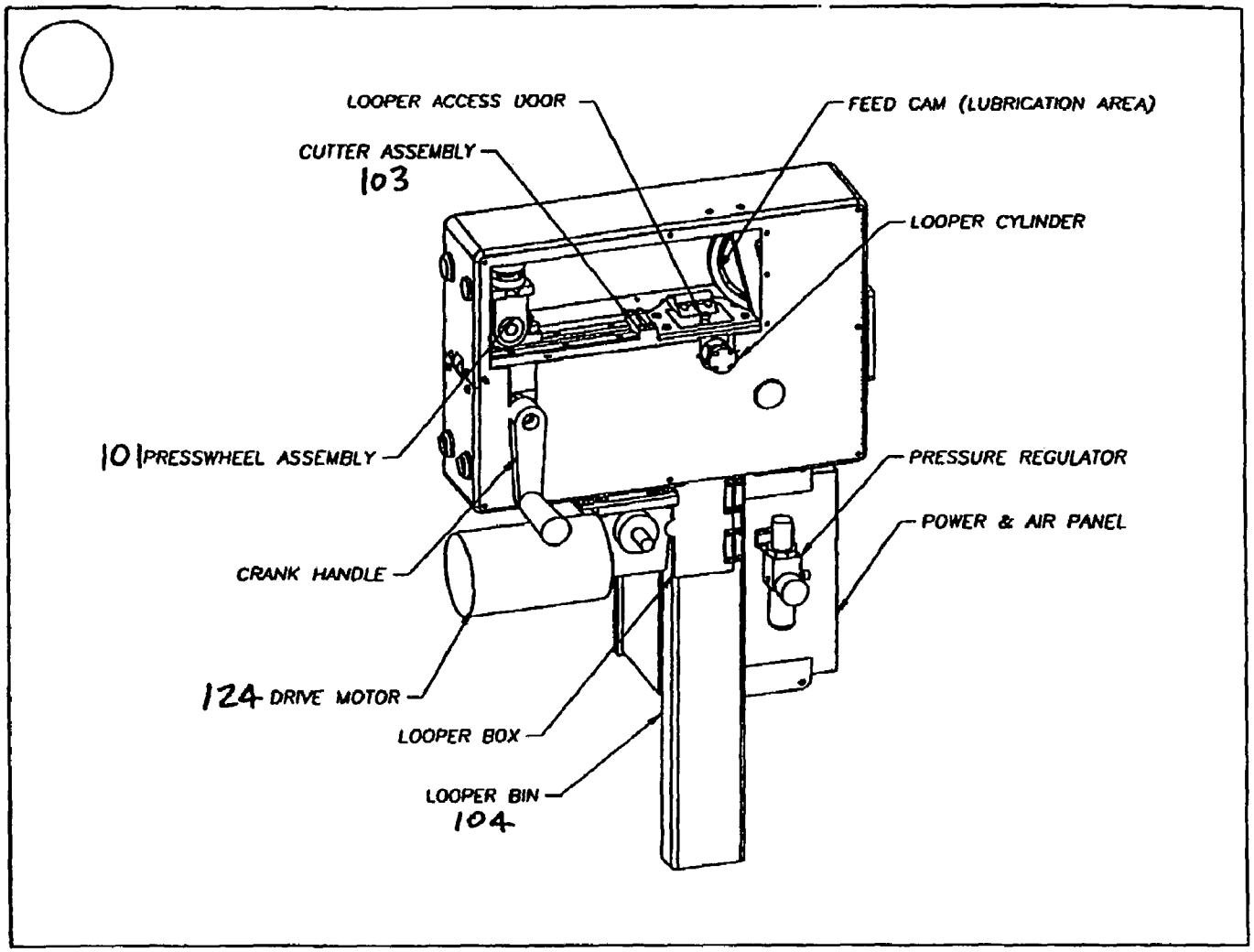
FIG. 2 is an illustration of a portion of the turn-up tape system according to one embodiment of the present invention.
Figure 3:
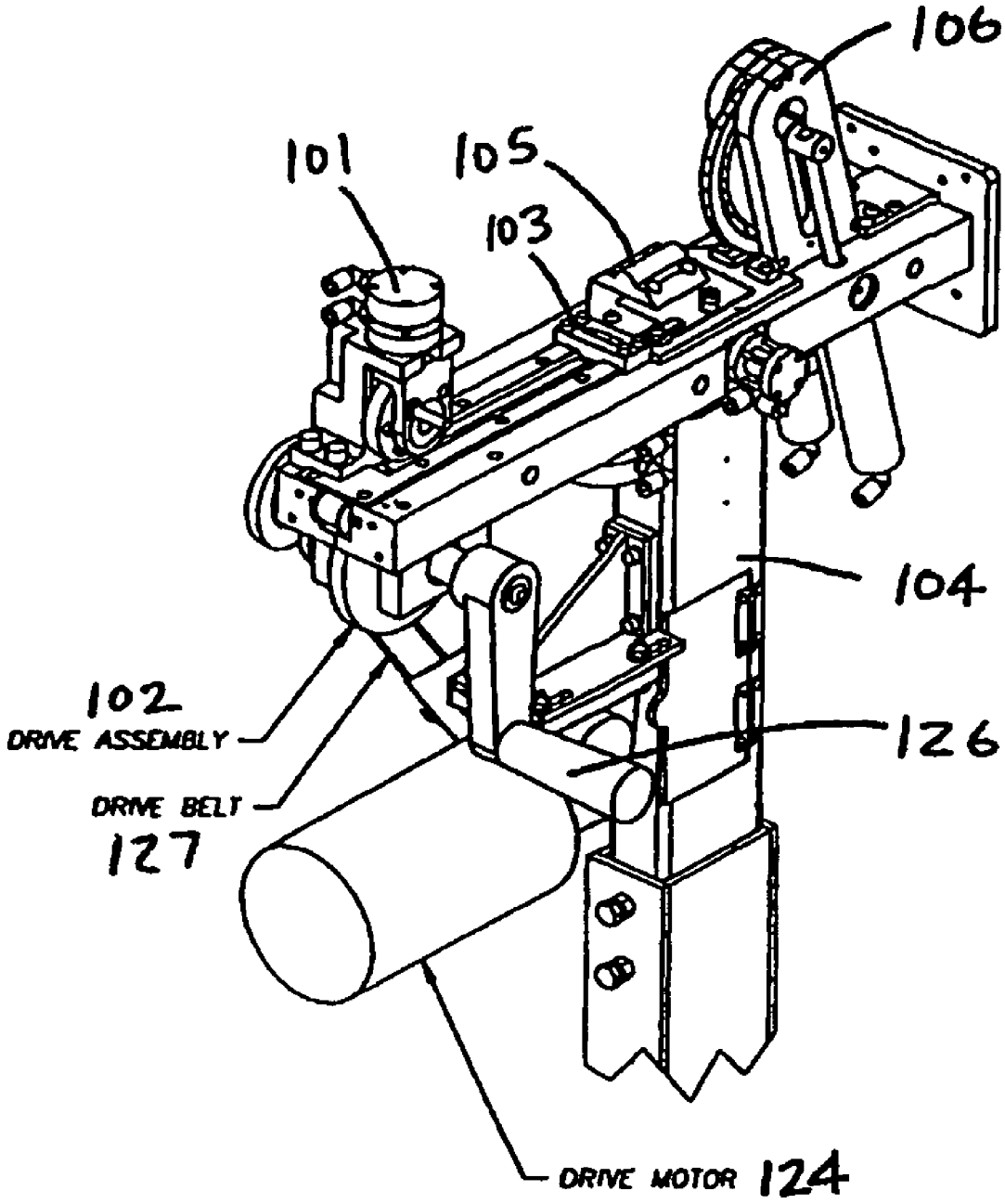
FIG. 3 is an illustration of a portion of the turn-up tape system according to one embodiment of the present invention.

FIG. 1 illustrates one embodiment of an improved turn-up tape system 100 for spooling and cutting a paper web. The turn-up tape system 100 can comprise of a drive assembly 102, a press wheel assembly 101, a cutter assembly 103, a loop assembly including a looper bin door assembly 105 and a looper bin 104, a cam assembly 106, a brake assembly 114 and a tape transfer track 107 with a horizontal section 108 and a turn-up section 109. Other embodiments of the turn-up tape system 100 are possible. FIGS. 2 and 3 also illustrate a portion of the turn-up tape system from the drive assembly 102 to the cam assembly 106 according to one embodiment of the turn-up tape system. In the embodiment shown in FIG. 1, the turn-up tape system 100 is positioned in relation to a paper web, empty spool (a second) and full (first) spool so that the paper web travels over the horizontal section of the transfer track and the turn-up section is positioned to deliver the turn-up tape to a nip between the paper web and empty spool.

The general operation of one embodiment of the turn-up tape system 100 in either automatic or manual mode will now be described with reference to FIGS. 1-3. First, turn-up tape can be inserted into the turn-up tape system. In order to do this, the press wheel assembly 101 can utilize an air cylinder to move a rubber coated engaging wheel 120 away from a drive wheel 122 of the drive assembly 102. Once the turn-up tape is appropriately positioned in the turn-up tape system, the press wheel assembly 101 can utilize the air cylinder to move the rubber coated engaging wheel 120 in position such that the turn-up tape is clamped between the rubber coated engaging wheel 120 and the drive wheel 122.

The drive assembly 102 can then move the turn-up tape along the system 100 over the looper bin door assembly 105, through the cam assembly 106, through the horizontal section 108 underneath the paper web and to the end of the turn-up section 109 toward the nip (not shown). The drive assembly 102 can be motor powered or manually powered. In one embodiment, adhesive can be applied to the forward end of the turn-up tape so that when placed in the nip it sticks to the new spool. This adhesive application can be done manually or can be done by a machine. The brake assembly 114 can then apply pressure to the turn-up tape by utilizing an air cylinder and a metal pad. The looper bin door assembly 105 can then utilize an air cylinder to open a looper bin door. This can allow turn-up tape to gather in the looper bin 104. The brake assembly 114 ensures that the tape goes in the looper bin 104 and prevents turn-up tape from passing the looper bin door assembly 105.

In one embodiment, after an appropriate amount of turn-up tape has collected in the looper bin 104, the cutter assembly 103 can cut the turn-up tape by utilizing an air cylinder equipped with a sharp blade. The brake can then be released and the drive assembly can be stopped. The cam assembly 106 can, when signaled at the appropriate time, utilize two air cylinders working in tandem to cause the turn-up tape to move into a nip between the empty spool and the paper web. After operation of the cam assembly 106, the brake of the brake assembly 114 can again be actuated to apply pressure to the turn-up tape. The turn-up tape can then be wound around the empty spool causing the tape to pull out of the track 107, cut the paper web, and start the paper web spooling on the empty spool.

Figure 10:
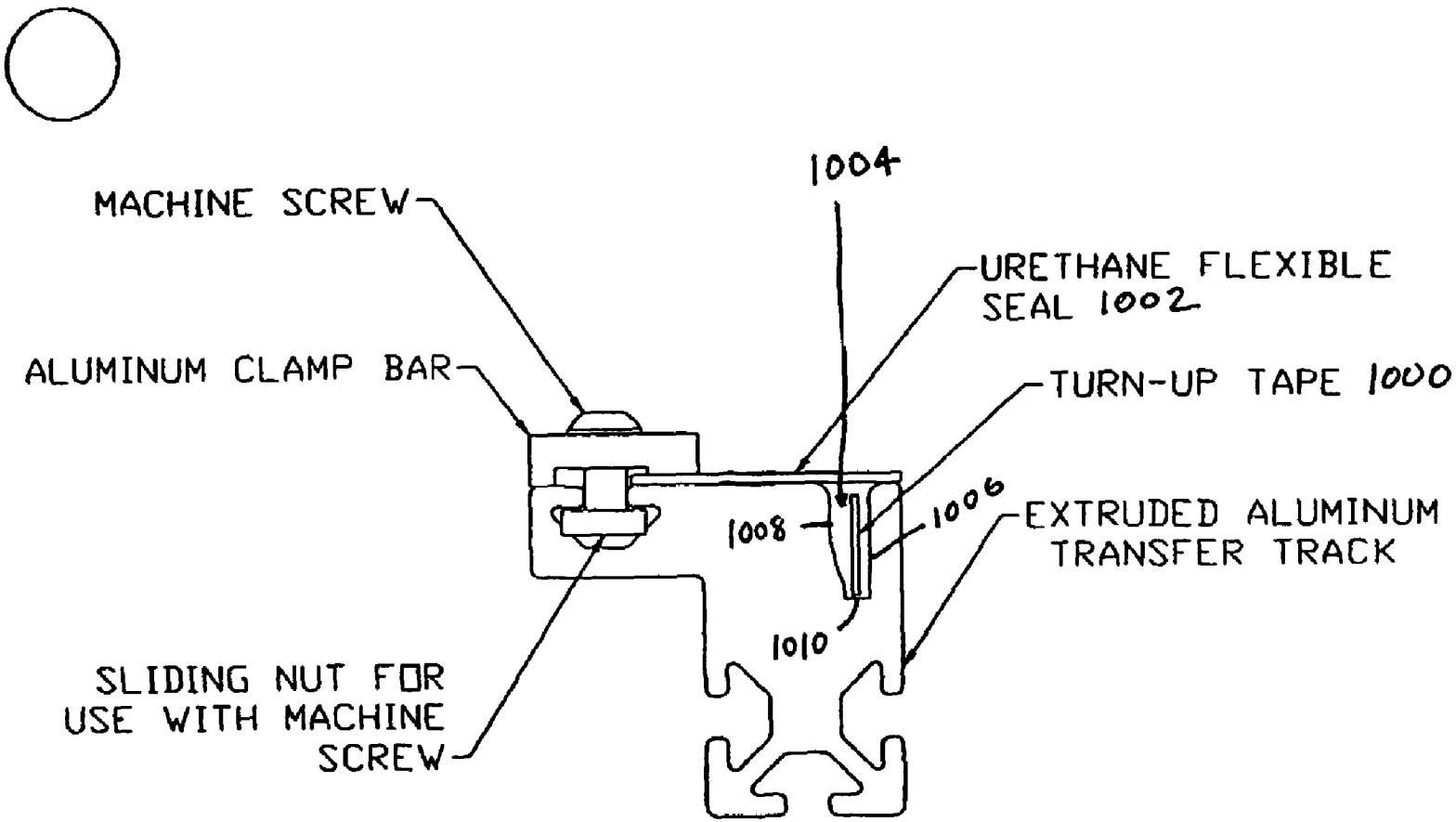
FIG. 10 is a cross sectional view of the transfer track according to one embodiment of the present invention.

FIG. 10 illustrates a cross section of the track 107 according to one embodiment of the present invention. In the embodiment show in FIG. 10, the turn-up tape 1000 travels through groove 1004. Groove 1004 can be covered by a flexible seal 1002. The flexible seal 1002 can keep debris out of the groove 1004, while still allowing the turn-up tape 1000 to pull out of the groove 1004. In one embodiment, the flexible seal is made from urethane, but other suitable materials can be used. As shown in FIG. 10, the groove 1004 can be generally V-shaped with a first wall 1006 and a second wall 1008 at an acute angle to the first wall 1006. In one embodiment, the first wall 1006 is substantially parallel with the cross section of the turn-up tape 1000 in the groove 1004. As shown in FIG. 10, the second wall 1008 can be concave or have a concave portion. This can help to alleviate binding of the turn-up tape 1000 in the groove 1004 and can prevent any adhesive that may be on the turn-up tape 1000 from attaching to the groove 1004 or otherwise preventing the turn-up tape 1000 from traveling through the groove 1004. A third wall 1010 can also form the groove 1004 that is substantially perpendicular with the cross section of the turn-up tape 1000 in the groove 1004. Alternatively, the track 1007 can be also be configured a variety of different ways as known to those skilled in the art, such as, for example, like the track configurations shown in U.S. Pat. No. 6,416,012, which is incorporated in its entirety by this reference.

Figure 4:
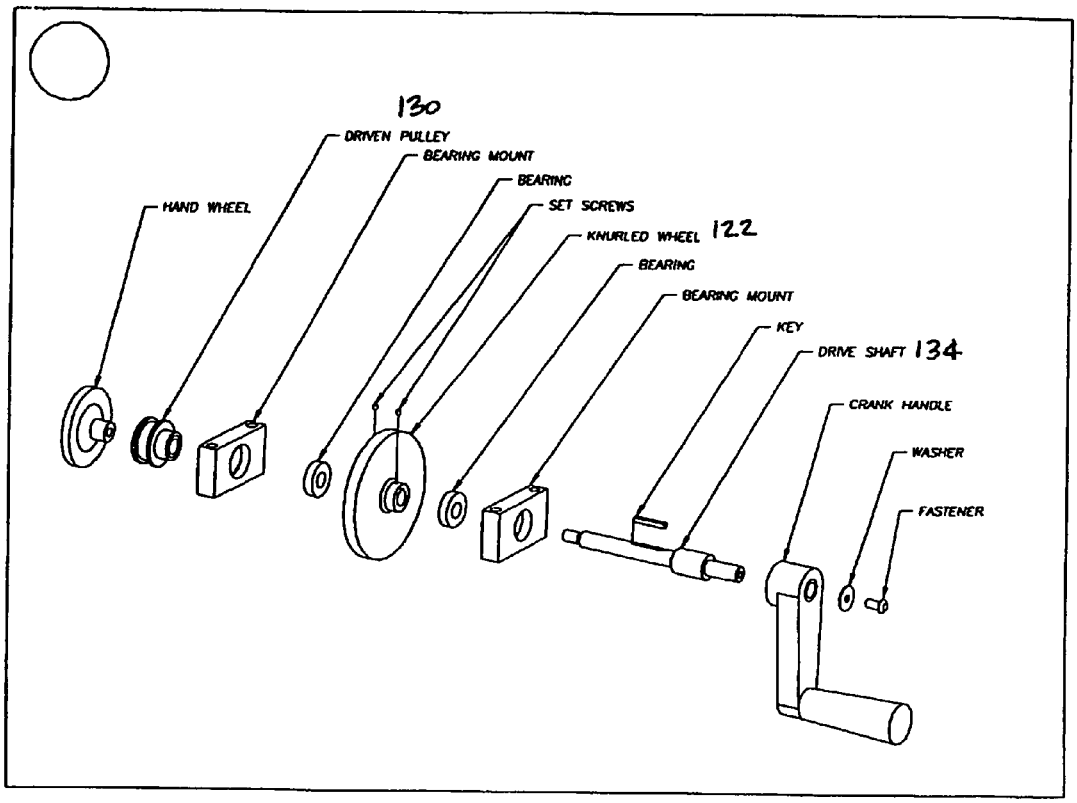
FIG. 4 is an exploded view of a drive portion of the drive assembly according to one embodiment of the present invention.
Figure 5:
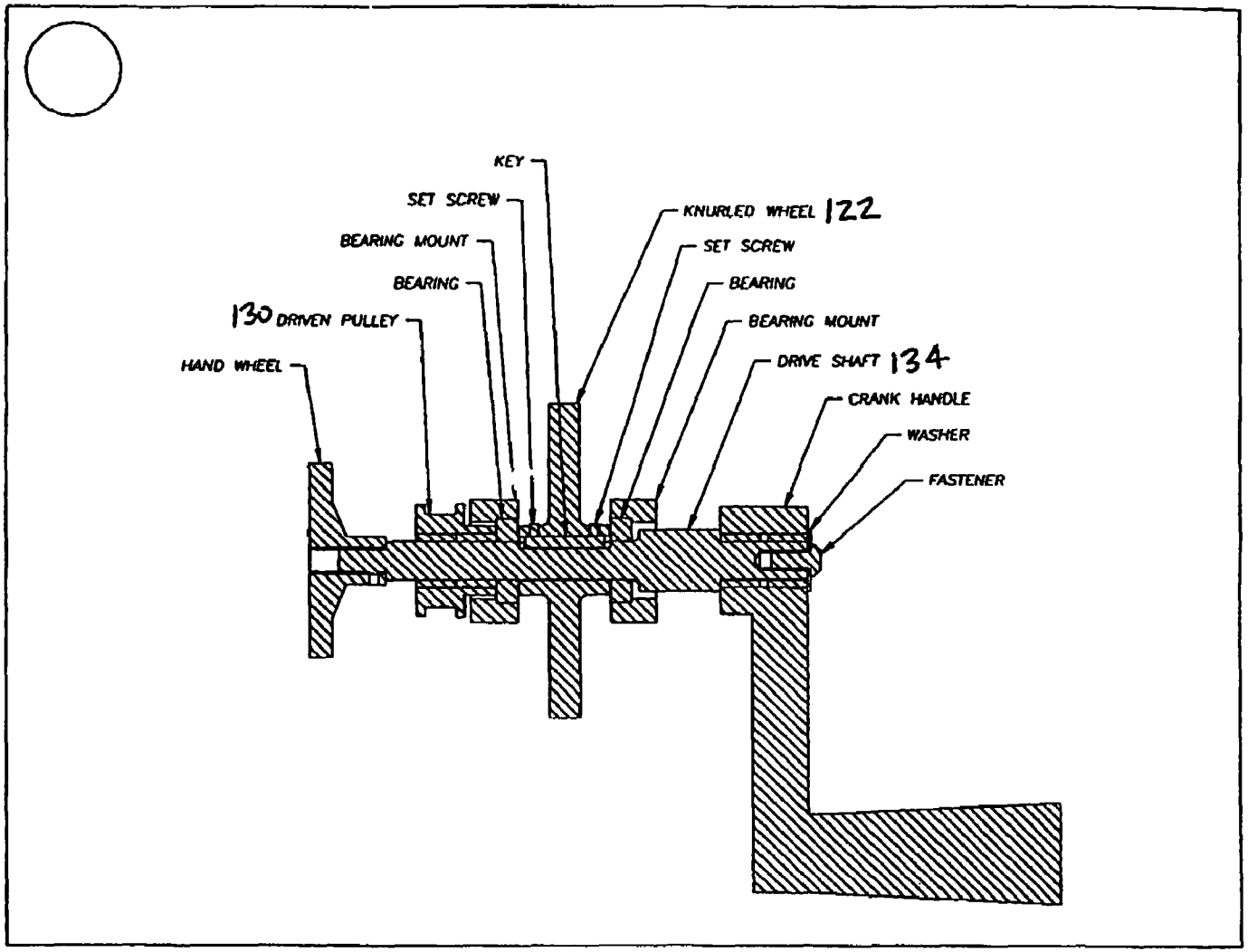
FIG. 5 is a cross sectional view of the drive portion of the drive assembly according to one embodiment of the present invention.
Figures 6, 7:
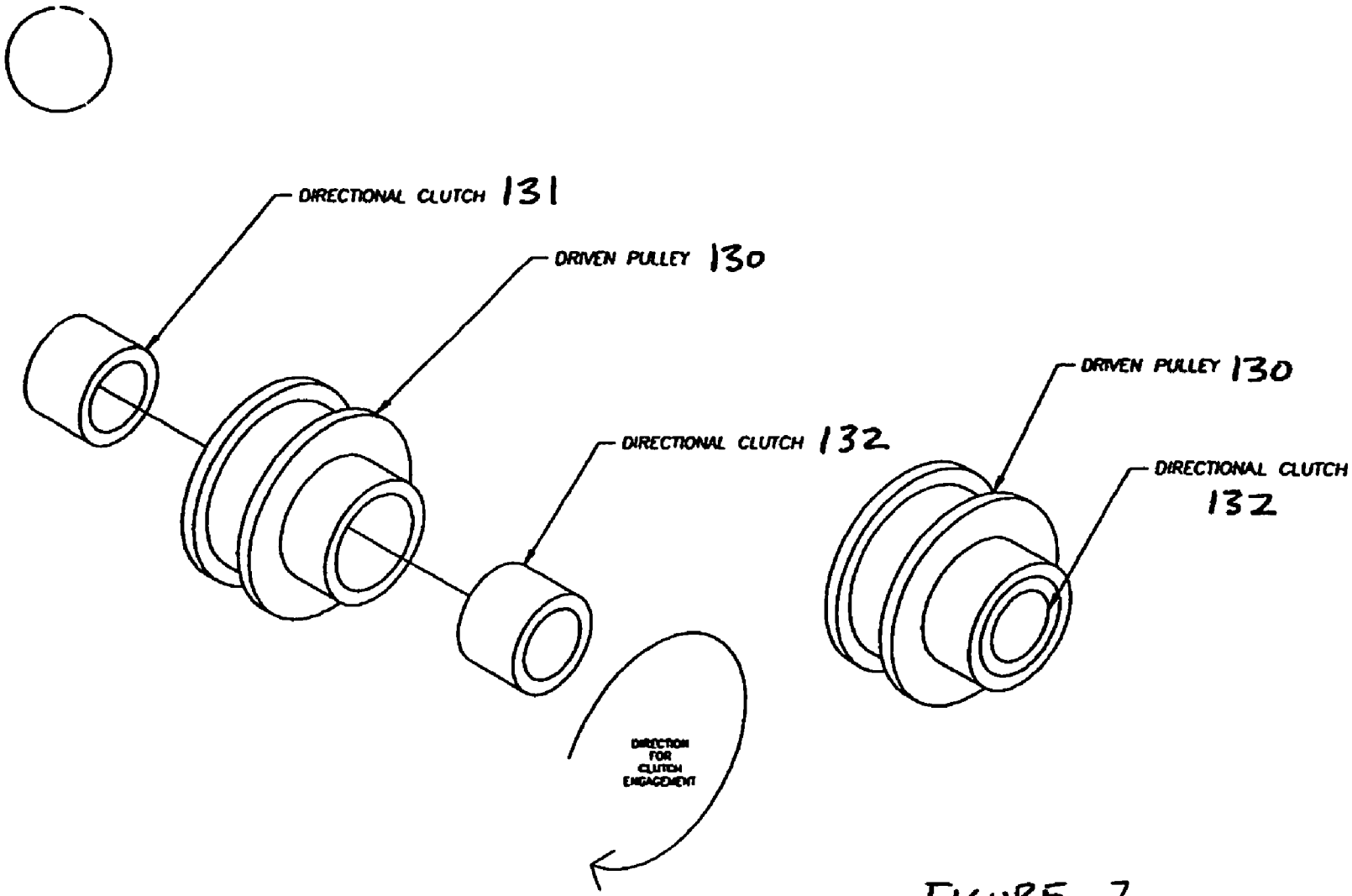
FIG. 6 is an exploded view of a driven pulley according to one embodiment of the present invention.
FIG. 7 is an illustration of the driven pulley according to one embodiment of the present invention.

The drive assembly 102 can provide the rotational force that is responsible for moving the turn-up tape through the system 100. The drive assembly 102 can be powered by either an electric motor 124 or a human powered hand crank 126. FIGS. 4-7 provide more detailed illustrations of portions of the drive assembly 102. FIG. 4 provides an exploded view of a drive portion of the drive assembly 102 according to one embodiment of the present invention. FIG. 5 provides a cross sectional view of the drive portion of the drive assembly 102 according to one embodiment of the present invention. FIG. 6 provides an exploded view of a driven pulley 130 and directional clutches 131, 132 and FIG. 7 provides a perspective view of the driven pulley 130 and directional clutches 131, 132 of one embodiment of the present invention.

The driven pulley 130 shown in FIGS. 4-7 can receive power from the drive motor 124 by way of a belt 127 (as shown in FIGS. 1 and 3). In one embodiment, this driven pulley 130 has an inside diameter sufficient to allow the press fit of two directional clutches 131, 132 (as shown in FIGS. 6 and 7). During electrically powered operations, these directional clutches 131, 132 can engage and rotate the drive shaft 134 when the pulley 130 is turned in a clockwise direction, for example, as shown in FIG. 6. The rotation of the drive shaft 134 causes the drive wheel to rotate, which when the engaging wheel 120 is in position drives the turn-up tape through the system 100. In one embodiment, when the system is manually powered, the motor 124, the belt 127, the pulley 130 and the directional clutches 131, 132 are stationary. In the manually powered case, the directional clutches 131, 132 can allow the shaft 134 to rotate freely without interference from the motionless electric motor 124 and pulley 130.

Figure 9:
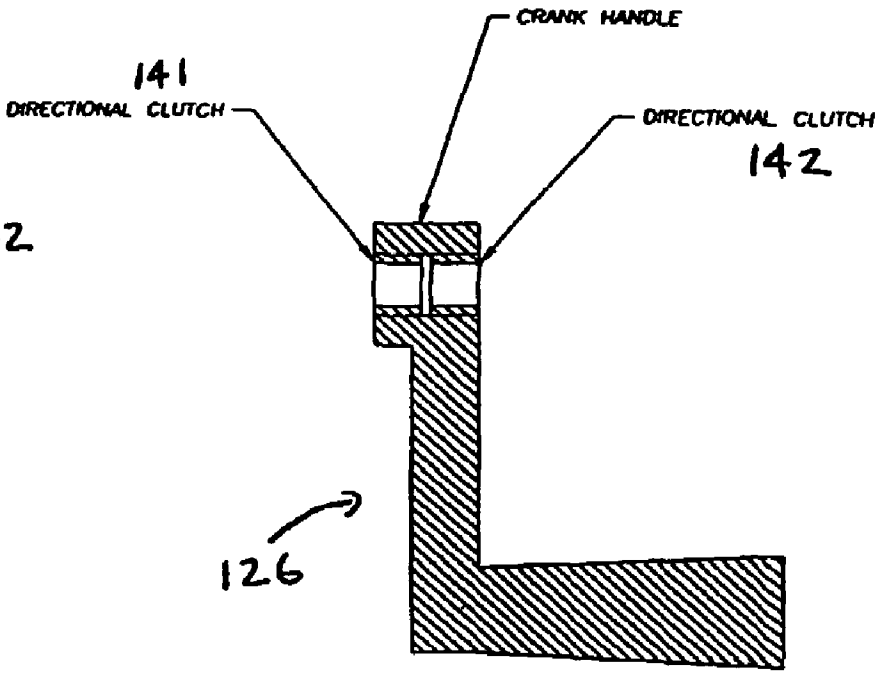
FIG. 9 is a cross sectional view of the hand crank according to one embodiment of the present invention.
Figure 8:
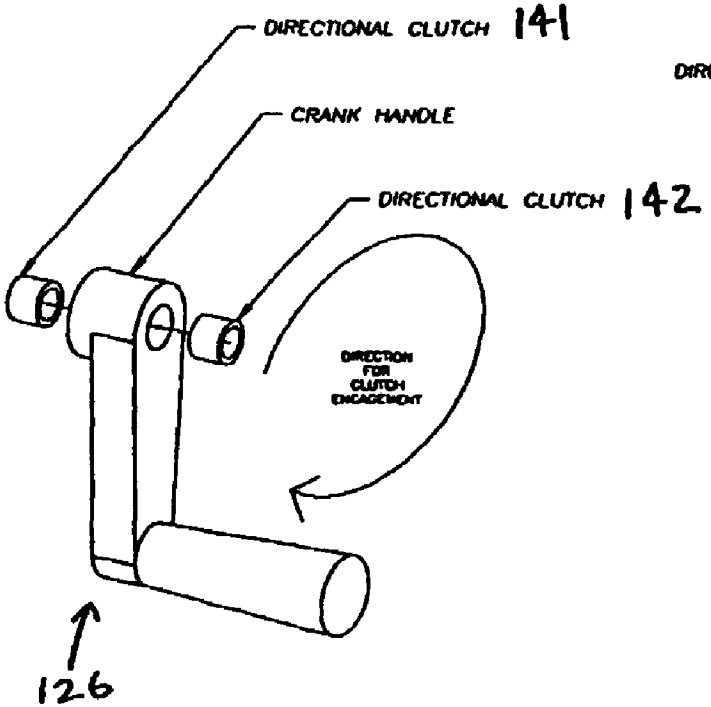
FIG. 8 is an exploded view of a hand crank according to one embodiment of the present invention.

The hand crank 126 can transmit power from a human being to the drive shaft 134 during manual operation causing turn-up tape to be driven through the system 100 similar to the motor powered mode described above. In one embodiment, this transmission of power can be accomplished by employing the assembly shown in FIGS. 8 and 9, which consists of two directional clutches 141, 142 that have been pressed into a machined bore inside the crank handle. These clutches 141, 142 can function to transmit torque to the drive shaft 134 when the handle is rotated in the clockwise direction shown, for example, in FIG. 8. However, when the system utilizes the electrically driven motor 124, the clutches 141, 142 and the hand crank 126 can be stationary. In the electrically powered case, the clutches 141, 142 can slip on the shaft 134 and allow the hand crank to remain essentially motionless while the shaft 134 rotates.

In one embodiment, the operation of the turn-up tape system 100, except for the drive assembly 102, is controlled by a pneumatic system that can be controlled automatically, such as by a computer or can be controlled manually. The pneumatic system can include three sub-systems, the Turn-Up Control sub-system, which controls the cam assembly 106 and the brake assembly 114, the Loop Control sub-system, which controls the looper bin door assembly 105 and the brake assembly 114 and the String-Up Control sub-system, which controls the press wheel assembly 101 and the cutter assembly 103.

Figure 11:
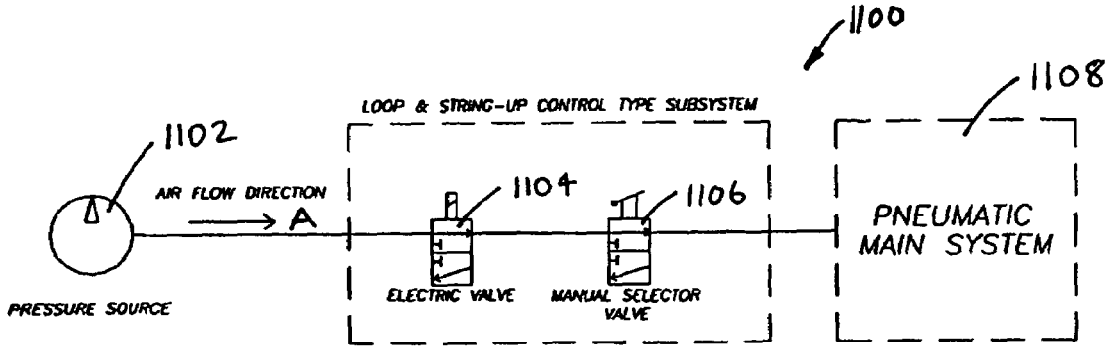
FIG. 11 illustrates a pneumatic control subsystem according to one embodiment of the present invention.

In one embodiment, the use of both manual controls as well as automated controls in a pneumatic system can be facilitated by the placement of both electrically actuated and manually actuated types of controls in a series configuration. FIG. 11 provides a schematic diagram of one embodiment of how this principal can be used in a pneumatic system 1100 that has a manually actuated, pneumatic type selector switch as its manual control. The pneumatic system 1100 shown in FIG. 11 can utilize a pressure source 1102, a selector switch type manually actuated pneumatic valve 1106, an electrically actuated pneumatic valve 1104 and a Pneumatic Main System 1108. In this embodiment, if the manual selector valve 1106 is turned to a position where air can flow freely through the manual valve 1106 in the airflow direction A control of the system is relinquished to the electrically controlled valve 1104 further up stream of the manual valve. A programmed computer can now control the Pneumatic Main System 1108 with a minimum of human interactions. The electrically actuated valve 1104 can be used such that without the presence of an electrical signal the valve 1104 allows the unrestricted flow of air through the valve in the air flow direction A. In this embodiment, the manual valve 1106 can be manipulated to control the system. This principal allows the turn-up tape system 100 to be controlled as both an automated turn-up system as well as a manual turn-up system. This type of pneumatic subsystem is used by the Loop Control and String-up Control Subsystems of the turn-up tape system.

Figure 12:
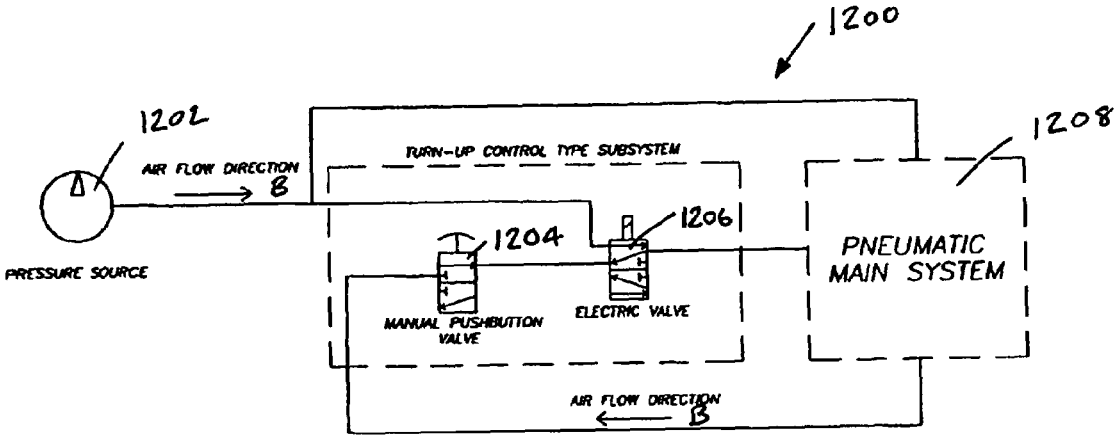
FIG. 12 illustrates a pneumatic control subsystem according to one embodiment of the present invention.

FIG. 12 illustrates another embodiment of a pneumatic system 1200. The pneumatic system 1200 of FIG. 12 can utilize a normally closed, manually actuated, pneumatic, pushbutton valve as its manual control. This system 1200 can utilize a pressure source 1202, a pushbutton type manually actuated pneumatic valve 1204, an electrically actuated pneumatic valve 1206 and a Pneumatic Main System 1208. In one embodiment, when this pneumatic system 1200 is used with the Turn-up Control Type Subsystem, the Turn-up Control Type Subsystem can source its air pressure from both an external pressure source as well as from a source within the Pneumatic Main System 1208. In one embodiment, the system 1200 utilizes a manual pushbutton valve 1204 that has a normally closed flow position. Thus, the valve 1204 cannot be set to a position where air can flow freely through the valve 1204. Because of this a second external air source can be utilized to supply the electrically actuated valve 1206 during automatic operations. To facilitate manual operations, an electrically actuated valve 1206 can be selected such that without the presence of an electrical signal the valve allows the unrestricted flow of air in the direction B through the valve. In this embodiment, the system 1200 can be operated manually. This type of pneumatic subsystem is used by the Turn-up Subsystem.

Each of the control subsystems can be responsible for dispersing pressurized air to either work in a single Pneumatic Main System or provide pneumatic signaling to additional pneumatic powered controls located in the Pneumatic Main System.

The String-up Control, Loop Control and Turn-up Control subsystems can be utilized to control the mechanical assemblies of the turn-up tape system with the exception of the drive assembly. Manual controls can be associated with each subsystem, for example, a the Turn-up Control button, a Loop Control selector switch, and a String-up Control selector switch.

Figure 13:
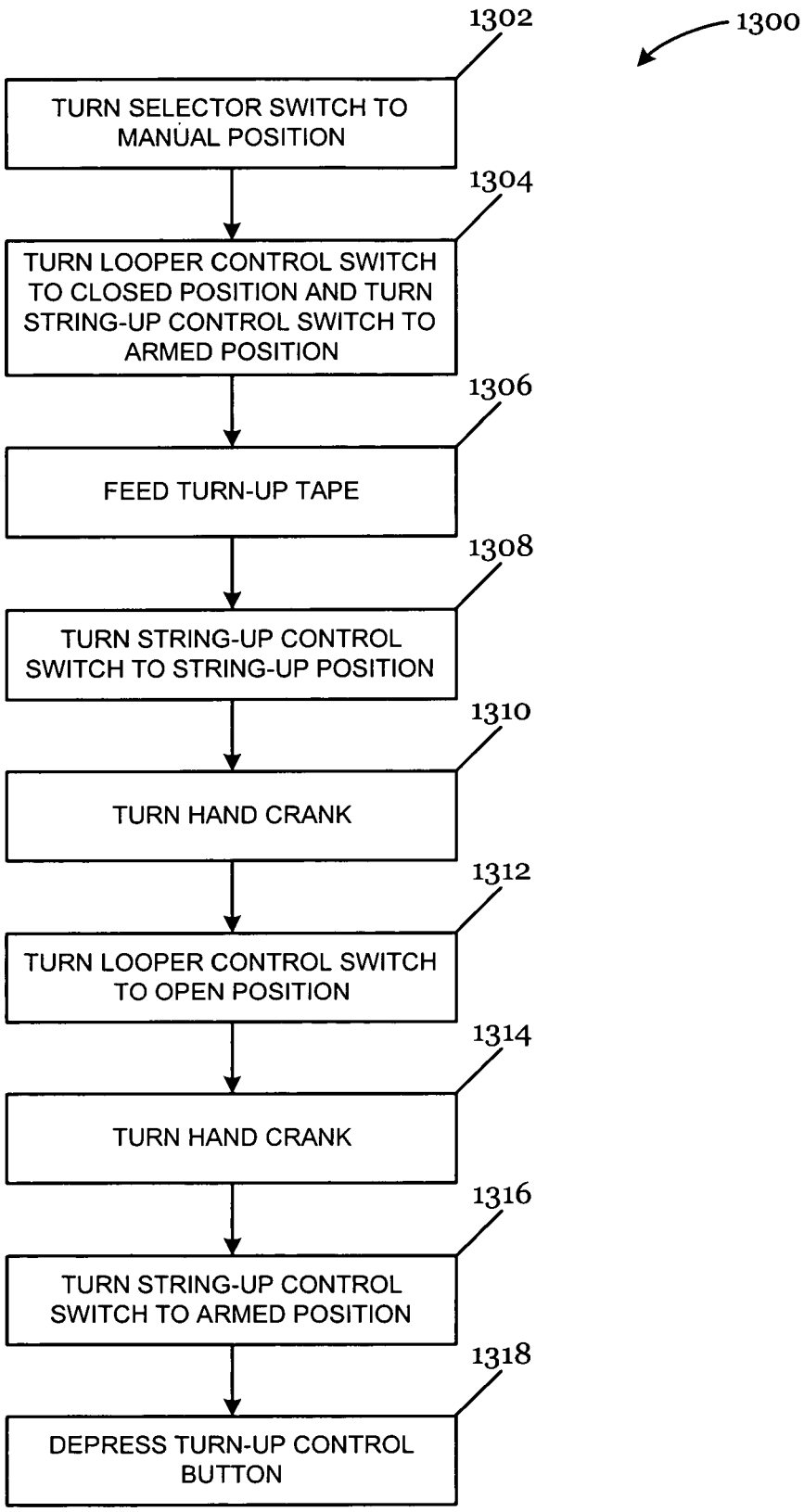
FIG. 13 illustrates a flow diagram for switching between automatic operation and manual operation of the turn-up tape system according to one embodiment of the present invention.

FIG. 13 illustrates an exemplary method 1300 of switching from automatic (computer controlled) operation to manual operation according to one embodiment of the present invention. In block 1302, an electric selector switch that can be located at a control panel associated with a controlling computer is turned to a manual position. The electric selector switch can indicate to the computer that the operator is now operating in manual mode. The computer can respond to such indication by removing the electrical voltages from the electrically actuated pneumatic valves of the control subsystems and the electric motor. This can place the electric actuated control valves into a configuration where air is allowed to flow through without obstruction.

In block 1304, a looper control switch is turned to a closed position and a string-up control switch is turned to an armed position. The actions in block 1304 can prepare the turn-up tape system to receive a piece of turn-up tape. When the looper control switch is turned to the "closed" position the Pneumatic Main System can apply air pressure to the air cylinder located on the looper assembly. This action can close the looper bin door not allowing the accumulation of turn-up tape in the looper bin and remove pressure from the brake assembly, which can allow turn-up tape to pass by the metal pad without interference.

When the string-up control switch is turned to the "turn-up armed" position the Pneumatic Main System can apply air pressure to the portion of the presswheel assembly's air cylinder that will cause the engaging wheel of the presswheel assembly to move away from the drive wheel of the drive assembly. This action can allow turn-up tape to be inserted into the machine without the interference of the presswheel assembly's engaging wheel. Simultaneously, the Pneumatic Main System can apply the appropriate air pressure configuration to the cutter assembly to cause the cutter blade to move into the position where the inserted turn-up tape will strike the cutter blade thus limiting the amount of turn-up tape that can be inserted into the machine.

In block 1306, turn-up tape is fed into the turn-up tape system until the turn-up tape comes into contact with the cutter blade from the cutter assembly. An operator can also add adhesive to the end of the turn-up tape before feeding the turn-up tape into the turn-up tape system.

In block 1308, the string-up control switch is switched to a "string-up" position. This can reverses the actions of the previous movement of this control to the armed position. In one embodiment, switching the string-up control switch to the string-up position can cause the Pneumatic Main System to apply the appropriate air configuration to the presswheel assembly to cause the engaging wheel to clamp the turn-up tape previously inserted into the machine against the drive assembly's drive wheel. Additionally, the Pneumatic Main System can cause the cutter Assembly to remove the cutter blade from in front of the inserted turn-up tape, which allows turn-up tape to be further inserted into the turn-up tape system.

In block 1310, the hand crank is turned a predetermined number of turns. The number of turns can be the number of turns necessary to dispense turn-up tape into the turn-up tape system to a specified quantity. For example, the hand crank is turned until the end of the turn-up tape is in position at the end of the track 107 to enter the nip.

In block 1312, the looper control switch is switched to the looper open position. The movement of the loop control switch to the "looper open" position can cause the Pneumatic Main System to apply the appropriate air pressure configuration to the looper assembly air cylinder. This application of air causes the cylinder to open the looper bin door and allow the accumulation of turn-up tape. Additionally, the Pneumatic Main System can apply the appropriate air pressure configuration to the brake assembly to cause the metal pad of the brake assembly to be pressed against the turn-up tape stopping any further collection of turn-up tape into the system past the brake assembly.

In block 1314, the hand crank is turned a predetermined number of times in a clockwise direction. This can cause the accumulation of turn-up tape in the looper bin, because the looper bin door is open and the brake assembly secures the turn-up tape at a point beyond the looper assembly. The number of turns of the hand crank can be the number necessary to accumulate a measured quantity of turn-up tape in the looper bin.

In block 1316, the string-up control switch is switched to the armed position. Turning the string-up control switch to this position can cause the Pneumatic Main System to cause the presswheel assembly to release the clamping pressure applied to the turn-up tape by the engaging wheel and cause the cutter assembly to move the cutter blade so as to cut the turn-up tape. In addition, the Pneumatic Main System can apply the appropriate air pressure configuration to cause the brake assembly to apply the appropriate air pressure configuration to cause the metal pad to be retracted from its previous position where it isolated the turn-up tape from motion. At this point, a measured quantity of turn-up tape can be contained in the turn-up tape system.

In block 1318, the turn up control button is depressed after the spool contacts the reel drum. Pressing the turn-up control button can signal the Pneumatic Main System to apply the appropriate air pressure configuration to the air cylinders contained in the cam assembly, which causes the cam assembly to feed a measured amount of turn-up tape, for example, eleven inches, to advance and travel into the nip of the paper production machinery. After the operation of the cam assembly, the brake assembly is activated so that it applies pressure to the turn-up tape. This constitutes the beginning of the turn-up process. At this point all turn-up tape in the turn-up tape system is removed from the machine by the paper production equipment. After the removal of the turn-up tape from the machine is complete the operator can return to block 1304 and begin the process again.

The foregoing description of exemplary embodiments of the invention has been presented only for the purpose of illustration and description and is not intended to be exhaustive or to limit the invention to the precise forms disclosed. Many modifications and variations are possible in light of the above teaching. The embodiments were chosen and described in order to explain the principles of the invention and their practical applications so as to enable others skilled in the art to utilize the invention in various embodiments and with various modifications as are suited to the particular use contemplated.

Figure 14:
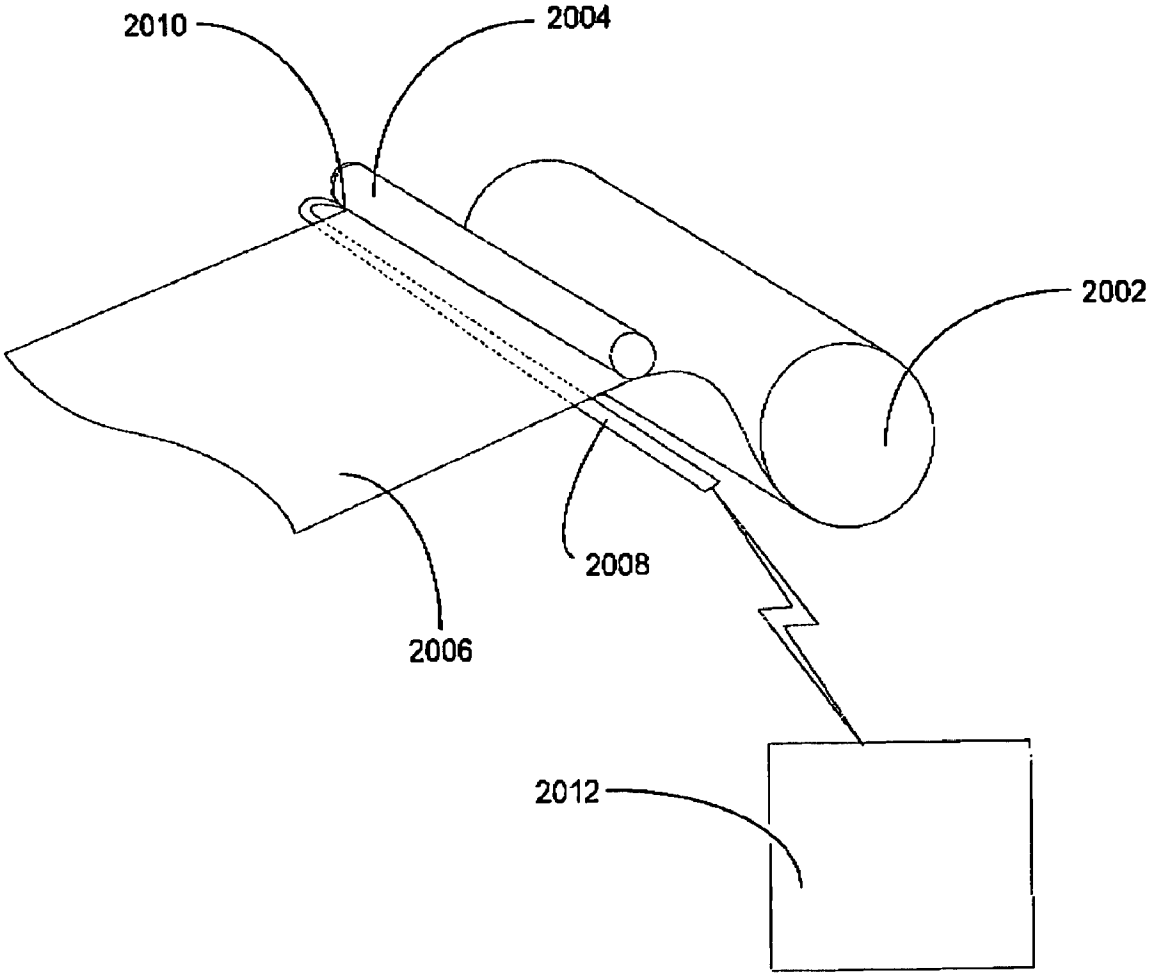
FIG. 14 schematically illustrates components of a turn-up tape system In relations to other components involved in spooling a paper web in accordance with one embodiment of the present invention.

FIG. 14 schematically illustrates a first spool 2002 and a second spool 2004 of a system for collecting a paper web 2006 in relation to a transfer track 2008 for directing a turn-up tape Into a nip 2010 between the second spool 2004 and the paper web 2006 in accordance with certain embodiments of the present Invention. FIG. 14 also shows a computer 2012 for controlling the pneumatic system of certain embodiments of the present invention.

What is claimed is:

1. A system for cutting a traveling web of paper that is being wound onto a first spool and transferring the paper web onto a second spool by feeding turn-up tape into a nip between the second spool and the paper web, comprising:

a transfer track for transporting the turn-up tape beneath the paper web and to a position adjacent to the nip; wherein the transfer track comprises at least in part a V-shaped groove capable of containing the turn-up tape, the V-shaped groove comprising a first side wall and a second side wall at an acute angle from the first side wall;

a drive assembly capable of driving the turn-up tape along the transfer track toward the nip, wherein the drive assembly comprises both a motor powered drive option and a manual drive option such that a user may switch between motor power and manual power as necessary;

at least a first clutch that engages a drive shaft during motor power operation; and at least a second clutch that engages a hand crank that engages the drive shaft during manual power operation, wherein when one clutch is engaged, the other is allowed to slip on the drive shaft and not engage.

2. The system of claim 1, wherein the second side wall of the V-shaped groove comprises a concave portion.

3. The system of claim 1, wherein the V-shaped groove is covered at least in part by a flexible seal.

4. A system for cutting a traveling web of paper that is being wound onto a first spool and transferring the paper web onto a second spool by feeding turn-up tape into a nip between the second spool and the paper web, comprising: a transfer track for transporting the turn-up tape beneath the paper web and to a position adjacent to the nip, wherein the transfer track comprises at least in part a V-shaped groove capable of containing the turn-up tape, the V-shaped groove comprising a first side wall and a second side wall at an acute angle from the first side wall, wherein the second side wall comprises a concave portion, wherein the V-shaped groove is covered at least in part by a flexible seal; and a drive assembly capable of driving the turn-up tape along the transfer track toward the nip.

5. The system of claim 4, wherein the drive is capable of being powered by manual power or motor power.

6. The system of claim 5, wherein the drive assembly comprises a drive shaft coupled to a drive wheel, the drive assembly also comprises an engaging wheel that is capable of engaging the turn-up tape between the drive wheel and the engaging wheel such that rotating the drive shaft in a predetermined direction drives the turn-up tape along the transfer track toward the nip.

7. The system of claim 6, wherein manual power is supplied to the drive assembly by a hand crank capable of rotating the drive shaft.

8. The system of claim 7, further comprising a first pair of directional clutches coupled to the hand crank and the drive shaft, wherein the first directional clutches engage and rotate the drive shaft when the hand crank is rotated in a predetermined direction and do not engage the drive shaft when the hand crank is not rotated.

9. The system of claim 6, wherein motor power is supplied to the drive assembly by an electric motor capable of rotating the drive shaft.

10. The system of claim 9, wherein the electric motor rotates the drive shaft by rotating a belt, wherein the belt is in rotational contact with a driven pulley that is coupled to the drive shaft by a second pair of directional clutches.

11. The system of claim 10, wherein the second pair of directional clutches are coupled to the driven pulley and the drive shaft, and wherein the second directional clutches engage and rotate the drive shaft when the driven pulley is rotated in a predetermined direction and do not engage the drive shaft when the driven pulley is not rotated.

* * * * *